United States Patent [19]

Hamilton

[11] 4,125,263

[45] Nov. 14, 1978

[54] DOMINO GAME

[76] Inventor: Joe W. Hamilton, 1390 Market St., Apt. 2224, San Francisco, Calif. 94102

[21] Appl. No.: 813,596

[22] Filed: Jul. 7, 1977

[51] Int. Cl.[2] ..... A63F 9/20

[52] U.S. Cl. ..... 273/293; 273/304

[58] Field of Search ..... 273/137 B, 137 C, 137 D, 273/152.4, 292, 293, 303, 304

[56] References Cited

U.S. PATENT DOCUMENTS

| | | | |
|---|---|---|---|
| 303,816 | 8/1884 | Crosby | 273/137 B |
| 615,818 | 12/1898 | Dexter | 273/137 C |
| 2,198,670 | 4/1940 | Johnson | 273/137 C |
| 2,782,039 | 2/1957 | Martin | 273/137 C |

FOREIGN PATENT DOCUMENTS

| | | | |
|---|---|---|---|
| 774,160 | 5/1957 | United Kingdom | 273/137 C |

*Primary Examiner*—Anton O. Oechsle

*Attorney, Agent, or Firm*—Townsend and Townsend

[57] ABSTRACT

Domino game apparatus comprising a plurality of domino game pieces that are divided into first and second sets of game pieces, each set being equal in number. Each individual game piece has a face that is provided with first indicia to (1) divide the face into two sections, (2) inscribe values in each section, and (3) distinguish the first set of game pieces from the second set of game pieces. A preselected game piece of the first set is provided with second indicia on the face thereof to denote special game-playing powers of the preselected game piece. The first and second sets are used in intermixed play. Points are awarded by adding or subtracting indicia values. The determination to add or subtract indicia values requires consideration of the game pieces already played and the game piece to be played.

11 Claims, 4 Drawing Figures

DOMINO GAME

This invention relates to domino game apparatus using two sets of game pieces that are played to selectively subtract or add numerals appearing on the game pieces for point awarding purposes.

BACKGROUND OF THE INVENTION

A variety of domino games are presently known, most of which typically use a number of flat, oblong-shaped game pieces. Each game piece has a face that is divided by a transverse line to form two generally square sections. Each section is inscribed with indicia that represents a particular value. Typically, such indicia takes the form of a number of depressions, commonly called pips, that appear in each section to a numeral that can range from naught to any number, depending upon the size of the domino set.

Most known conventional domino games are played by forming a line of domino game pieces of any type of flat playing surface (e.g., a table) as players make their plays, generally, but not always, by matching the numerals on the faces of the game pieces. That is, each domino game piece is laid face up on the table for play so that the piece played with match and adjoin an open end of the already played game pieces, a five being played to a five, a three being played to a three, and so on.

Scoring is accomplished by totaling, in one fashion or another, the depressions (or numerals represented thereby) that appear at the ends of the line of play as the game progresses. For example, the most common domino game, Muggins, is played by laying the tiles so as to make the number of depressions at the ends of the line of play add up to multiples of five. Points are awarded for each five depressions made.

Many other games have variations of play, but so far as is known, all use generally the same method of scoring, i.e., the addition of depressions in one manner or another. An excellent discussion of the various domino games that may be played can be found in "The Domino Book" by Frederick Berndt, published by Bantam Books, Inc. of New York, New York.

Typically, domino sets are referred to as double-N sets, with N representing the highest numeral appearing on the face. A typical set of domino game pieces consists of $\frac{1}{2}(N+1)(N+2)$ individual game pieces. Game pieces having the same numeral appearing on one section of their faces form a "suit". The game pieces of each suit have a numeral (usually represented by the depressions discussed above) appearing on the remaining section of their faces running consecutively from the numeral of the suit down through blank. Thus, for example, a double-six set would consist of $\frac{1}{2}(6+1)(6+2)$ or 28 game pieces having the following values:

(1) Double-six, six-five, six-four, six-three, six-two, six-one, six-blank;
(2) Double-five, five-four, five-three, five-two, five-one, five-blank;
(3) Double-four, four-three, four-two, four-one, four-blank;
(4) Double-three, three-two, three-one, three-blank;
(5) Double-two, two-one, two-blank;
(6) Double-one, one-blank; and
(7) Double-blank.

However, so far as is known, no domino game combines adding and subtracting the numerals or depressions that appear at the ends of the line of play in a single game.

SUMMARY OF THE INVENTION

Therefore, to expand the scope of play of present-day domino games, the present invention provides domino games apparatus comprising a plurality of domino games pieces that are divided into first and second sets of game pieces, each set having an equal number of game pieces. Each individual game piece has a face that is provided with a first indicia that divides the face into two sections, forms a value-representing numeral in each section, and distinguishes the first set of game pieces from the second set of game pieces. A preselected one of the game pieces of the first set is provided with second indicia on the face thereof to denote special game-playing powers of that game piece.

In the preferred embodiment the first and the second sets of game pieces each consist of 28 game pieces and each forming, if considered alone, a double-six domino set with the numerals appearing as with usual domino double-six sets. Thus, the domino game apparatus of the present invention, in this preferred embodiment, would consist of a total of 56 game pieces.

Each game piece is generally flat and oblong in shape. The face of each game piece is divided into two generally equal sections, each section containing numerals, represented by a number of colored depressions, that range from blank to six. To distinguish the first set of game pieces from the second set of game pieces, the depressions and any demarcation of the first set are of a contrasting color, relative to the color of the depressions and demarcation of the second set.

The double-five of the first set is provided with additional indicia to indicate additional game-playing powers of that piece.

The game pieces of the present invention are intermixed in play and play itself differs significantly from that of other domino games in the following aspects: First, while scoring is determined by taking into consideration the numerals represented at the open ends of the line of play as in known domino games, the game piece type (e.g., whether of the first set or the second set) must also be considered. Second, numerals can be subtracted, added, or not totalled at all, depending upon whether the total is obtained from primarily numerals of the first set or second set. Additionally, the game includes play of the individual piece with special game-playing powers which include the ability to capture an opponent's previous score as well as scoring additional points on behalf of the player playing the piece.

The game apparatus of the present invention, even when playing by rules similar to that of the well-known Muggins domino game, allows for play that is substantially more intricate than any present domino game. Thus, the scope of play of presently known domino games can be greatly expanded. Since the present invention provides game pieces that can be distinguished by type, the capability of providing a method of scoring that varies as play continues, is obtained. Players are able to obtain points in a variety of ways — either by adding or subtracting the open end numerals, depending upon the type (e.g., first set or second set) that is dominant.

For a fuller understanding of the nature and advantage of the game apparatus of the present invention, reference should be had to the ensuing detailed description taken in conjunction with the accompanying drawings.

DETAILED DESCRIPTION OF THE PREFERRED EMBODIMENT

Figure 1:
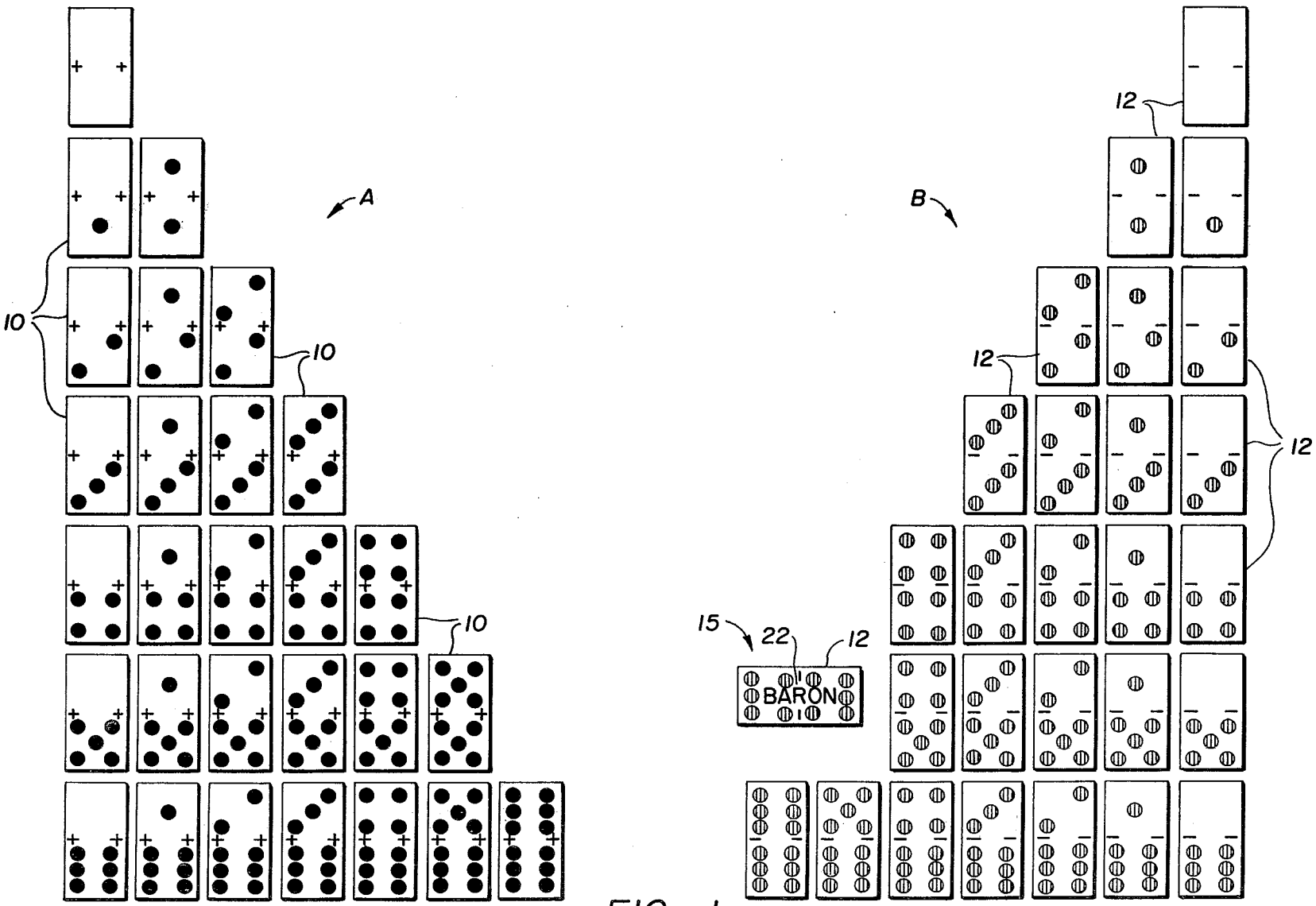
FIG. 1 is a plan view of a double-six set of game pieces fabricated in accordance with the teachings of the present invention.

Turning now to the drawings, FIG. 1 illustrates a preferred embodiment of the invention. As seen in this FIG., a domino-like game apparatus includes two separate and distinct sets A and B, each set containing an identical number of game pieces 10 and 12, respectively.

Basically, each set A and B comprise what is typically termed the "double-six" domino set, referred to above. It should be noted, however, that the game apparatus of the present invention can use two double-anything domino sets; double-six domino sets have been found preferable, however, because the greatest amusement will be derived when there are two to eight players and a 56 game piece set covers this range of players most satisfactorily. Thus, each set includes 28 game pieces 10 for a total of 56 game pieces. As will be seen, the game pieces of set A are distinguished from the game pieces of set B by the color used in the depressions 20 (FIGS. 2 and 3) which represent the numerals appearing on the game pieces and the demarcation signs 16 (FIG. 2) and 18 (FIG. 3) which divide the face 14 of each game piece.

The game pieces 10 of set A are identically formed except for the number of depressions which appear on the face of each game piece. The same is true of game pieces 12 of set B, with an additional exception which will be noted below. Therefore, the game pieces 10 of set A and 12 of set B will be described with reference to the individual four-blank game pieces 11 and 13 shown in FIGS. 2 and 3. It should be kept in mind that, unless otherwise noted, the descriptions of the individual game pieces of FIGS. 2 and 3 will apply equally to all games pieces 10 and 12, respectively, of sets A and B.

Figure 2:
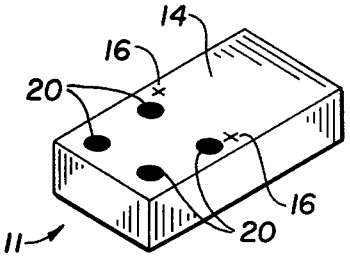
FIGS. 2 and 3 are perspective views of the four-blank game pieces from each of the two sets of game pieces, respectively, which comprise the game apparatus of the present invention.
Figure 3:
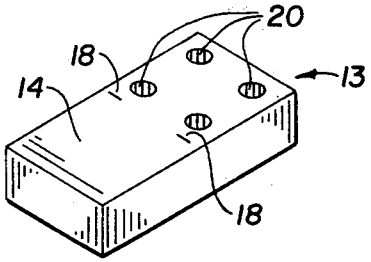

Referring now to FIGS. 2 and 3, there are shown the four-blank game pieces of sets A and B and designated by reference numerals 11 and 13, respectively. Each game piece is provided with a face 14 upon which appears demarcation indicia 16 (for the game pieces of set A) and 18 (for the game pieces of set B) which are positioned to divide faces 14 into two equal face portions. As can be seen, and for reasons that will be discussed below, the demarcation indicia 16 used on the game pieces of set A are algebraic plus signs. The game pieces of set B utilize a negative sign as demarcation indicia 18.

Each area designated on faces 14 of the game pieces by demarcation indicia 16 or 18 may be blank or may be provided with one or more depressions 20 which represent a numeral between one and whatever other number is desired, here six. The depressions 20 and demarcation indicia 16 of piece 11 (and all game pieces of set A) are of a constrasting color to that used on the depressions 20 an demarcation indicia 18 of piece 13 (and all game pieces of set B). Thus, for example, the indicia 16 and depressions 20 appearing on faces 14 of the game pieces of set A may be colored black while the demarcation indicia 18 and depressions 20 appearing on the faces of set B could be red in color.

One additional feature distinguishes the five-doublet 15 piece of set B from its counterpart of set A, as well as all other game pieces of the present invention. The face 14 of the five-doublet 15 is provided with indicia 22 to designate special game-playing powers of the game piece. Here, the notation BARON is used to form indicia 22 and to distinguish this piece from the others. These powers will be more fully described below when use of the game pieces of the present invention is discussed.

Game apparatus of the present invention may be used in accordance with any one of a number of domino game rules wherein the game pieces are played by forming a line on a table or other smooth surface as players make their plays, matching the numerals represented by the depressions 20 that appear on the face of each game piece. This line of game pieces is called the line of play. As pointed out above, the game pieces are typically joined to the line of play either with the line or across the line of play in the case of doublets. A part of the score is obtained from the total number of depressions at the ends of the line of play as the game progresses. The line of play, generated by laying the game pieces so as to make the number of depressions at the ends of the line of play, add up to multiples of five. One point is awarded for each five depressions made on the table. A more complete discussion of the game may be found in "The Domino Book", supra.

Having set forth the apparatus of the present invention, to-wit: the structure of the game pieces which comprise the improved domino set, the remaining description will discuss rules applicable to the use of the game pieces and will conclude with an illustration of play.

Play, using the game apparatus of the present invention, is essentially the same as a typical domino Muggins game with the game pieces of sets A and B being used in intermixed play. However, significant differences exist which make play much more intricate and create an immensely interesting domino game not heretofore known. The following rules of play are contemplated as one method of use of the game apparatus of the present invention:

STARTING PLAY. All 56 game pieces of both sets, A and B, are placed face down on a flat playing surface and thoroughly mixed by moving them about, flat on the surface, with the hands.

DRAWING HANDS. Depending on the number of players, the game pieces are drawn in serial sequential fashion by the players before play begins as follows:

- For 2, 3 or 4 players: Each player, in sequential and serial fashion, draws a game piece from the intermixed total until each has 11 game pieces each in his hand;
- For 5 players: Each player similarly draws 11 pieces, as above, taking care that at least one double-blank is left with the remaining, face-down game pieces;
- For 6 players: Each draws 9 game pieces, making sure that both double-blank game pieces are left with the remaining, face-down game pieces;
- For 7 or 8 players: The 56 intermixed game pieces are divided equally among the players.

ORDER OF PLAY. Typically, as in most domino games, the player with the highest double in his hand makes the first play — although any method can be used to select who is to be first to play. Thus, after the hands have been drawn, the double-six (or whatever the highest double of the set is) depending upon the set being used, is called for, and the player who has it plays it as the lead. After the first game piece has been played, the play progresses to the left.

LINE OF PLAY. The game pieces 10 and 12 of the present invention are played as would regular domino-type game pieces; that is, each game piece 10 or 12 (of set A or B, respectively) is played on a smooth playing surface, face up, to form a line of game pieces as the players make their plays, by matching the numeral of the piece to be played to one of the open end numerals on the line of play. In the case of doubles (e.g., a double-six, etc.) the game piece is played crosswise. An exception to this rule is the BARON game piece 15 which may be played both crosswise or end-to-end.

POINT TOTALLING. As in most domino games, points are obtained by totalling the numerals (e.g., the depressions 20 that represent the numerals) that appear at the ends of the line of play as the game progresses. Typically, only multiples of five are scored (although other domino games use various other methods of scoring). Thus, the game pieces are played or layed out to form the line of play so that the numerals appearing at the ends of the line add up to multiples of five. Using the intermixed game pieces 10 of sets A and B of the present invention, however, allows point totalling in the following manner:

1. If all open-end numerals are red or black, the numerals are added to achieve point totalling;
2. If the numerals (that is, the dots forming the numerals) appearing at the open ends are intermixed and a majority of them are red, the red and black numerals are added;
3. If the majority of the intermixed numerals are black, the red numerals are subtracted from the black; and
4. If the red and black numerals are equal in number, there is no count.

THE BARON. As pointed out above, the five-doublet game piece 15 of set B, identified as the BARON, possesses exceptional game-playing character and privileges. For example, the player holding the BARON game piece may play it at any time — even out of regular turn — without affecting the holder's next turn at play. The player simply calls out an exclamatory phrase such as NULLO and plays the BARON piece to any open end 5 numeral. If the play just preceding this maneuver produced points, those points are captured by the player of the BARON 15 and deducted from the previous player's score.

COUNTING AT END OF PLAY. Play terminates when the first player plays his last game piece or when no contestant can make a play. In the former instance, the player who "goes out" (plays his last game piece) is awarded one point for each multiple of five contained in the total of the numerals appearing on the game pieces which remain in each of the opponents' hands. Furthermore, opponents are penalized for game pieces 12 of set B which they may hold in their hands at game's end. The numerals of set B game pieces are totalled, divided by five, rounded off to the nearest five and the number obtained deducted from the opponent's score. If, at game's end, an opponent is caught with the BARON game piece 15 unplayed, two points are deducted from the holder's score and four points are awarded to the winner of that hand.

Figure 4:
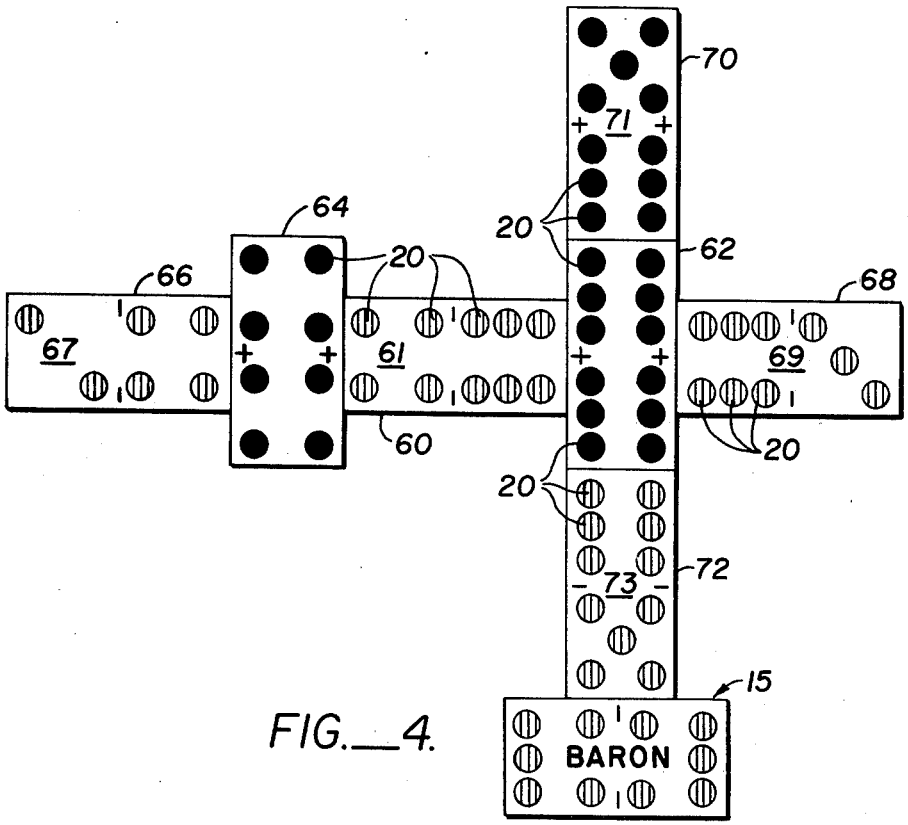
FIG. 4 is a plan view of a number of selected game pieces illustrating a line of play.

Having set forth the rules of play to be used in connection with the game apparatus of the present invention, a number of plays will be described with reference to FIG. 4 to further illustrate use of the game apparatus and facilitate an understanding of the game played. Assume at the outset that there are three players, X, Y and Z, that player X for one reason or another has been selected to play first and that play will proceed from X to Y to Z back to X and so on.

X plays game piece 60, a six-four piece from set B. Since this is the first game piece played and all depressions 20 are one color, the depressions are added and divided by five to achieve a point total, if any. Thus, X obtains two points by this play.

Y then plays game piece 62, the double-six from set A. The depressions that form the ends of the line of play — that is, the numerals represented by the depressions 20 that appear on the half-face end 61 of game piece 60 and all depressions 20 that appear on game piece 62 — are considered to determine if player Y has obtained points. Note that there are twelve set A type depressions (game piece 62) and four set B type depressions (end 61 of game piece 60) forming the free ends of the line of play thus far. Since a majority of the depressions are set A, set B depressions are substracted therefrom to obtain a result which is not a multiple of five and, therefore, no points obtained by Y.

Player Z plays the double-four game piece 64 from set A. The line of play is formed by game pieces 60, 62 and 64. The ends of the line of play are game pieces 62 and 64, the depressions 20 of which total 20, are all one color and, therefore, obtain for player Z four points $((8+12)\div 5=4)$.

It is now player X's turn again, who plays game piece 66, a four-two from set B. The free end depressions of the line of play now appear on game pieces 62 and 66 and are majority set A so that the two open depressions 20 which appear on the free half-face end 67 to game piece 66 are subtracted from the twelve open depressions 20 of game piece 62 to achieve a total of 10, which is a multiple of five and therefore two points for the player of game piece 66 — player X.

Player Y plays game piece 68, a six-three from set B. The depressions 20 appearing at the free ends of the line of play (e.g., half-face end 67 of game piece 66 and half-face end 69 of game piece 68) now are all of set B and, according to the method of play set forth above, are added to total five and obtain one point for the player.

Game piece 70 is played by player Z. Note now that of the total number of depressions that appear at the open ends (e.g., the two depressions 20 on half-face 67 of the piece 66, the three depressions on half-face 69 of game piece 68, and the five depressions on half-face 71 of game piece 70) there is no majority number of depressions from either set A or set B. Therefore, no count is made.

Player X then plays game piece 72 which provides the line of play now formed by game pieces 60, 62, 64, 66, 68, 70 and 72. The open end set A type game piece depressions appear on half-face end 71 of game piece 70 and total five. Similarly, there are ten set B game piece depressions appearing at the open ends of the line play (e.g., half-face ends 67, 69 and 73 of game pieces 66, 68 and 72, respectively). Since set B game piece depressions are in the majority, all dots are added for a total of 15 and three points for player X.

Player Z, who we will assume holds the BARON game piece 15, senses an opportunity to obtain a large number of points. It will be remembered that the holder of the BARON game piece 15 may play out of turn. Thus, although the next in play turn should be player Y, player Z calls out NULLO and plays the BARON on the half-face end 73 of game piece 72 as shown. Note that the open end depressions, which now comprise all depressions appearing on game piece 15, the three depressions on half-face 69 of game piece 68, the five depressions on half-face 71 of game piece 70 and the two depressions on half-face 67 of game piece 66, are majority of set B and total 20. Thus, player Z obtained four points for his own twenty-depression play and captures the count made by the previous play of player X (three points) for a total of seven points.

What is claimed is:

1. Game apparatus, comprising:

two sets of game pieces, the game pieces of the one of the two sets being equal in number to the game pieces of the other of the two sets, each one of the game pieces having a space and first indicia thereon forming a pair of numerals on the face uniquely identifying each one of the game pieces of each one of the sets, the numerals formed on each one of the game pieces of the one set corresponding to like numerals formed on one of the game pieces of the other set, the highest numeral used on the face of the game pieces being N, the number of game pieces totaling $(N+1)(N+2)$, the first indicia including means for distinguishing the game pieces of the one set from the game pieces of the other set; and second indicia on the face of a predetermined one of the game pieces of the one set to denote special game playing powers of said predetermined game pieces.

2. The game apparatus in claim 1, wherein the pair of numerals appearing on the face of the predetermined game piece are 5, 5.

3. The game apparatus of claim 1, wherein each one of the game pieces are identical in shape, the shape being elongate and rectangular.

4. The apparatus of claim 1, wherein the second indicia is the notation BARON.

5. The apparatus of claim 1, wherein the first indicia includes visible depressions on the face of each one of the game pieces, the number of depressions denoting the numeral.

6. The game apparatus of claim 5, wherein the distinguishing means includes color and the first indicia of the one set is of a contrasting color relative to the first indicia of the other set.

7. The game apparatus of claim 1, wherein N is equal to 6.

8. Domino game apparatus for use in intermixed play, comprising in combination:

a first double-six domino set of game pieces;

a second double-six domino set of game pieces, each one of the game pieces of the second set having first indicia to distinguish the game pieces of the second set from the game pieces of the first set; and second indicia on a five-doublet game piece of the second set to denote the five-doublet game piece as having special game playing powers.

9. The domino game apparatus of claim 8, wherein each of the game pieces of the first set and the second set includes numeral representative depressions that are of a contrasting color, respectively.

10. The domino game apparatus of claim 9, wherein each one of the game pieces includes a face for receiving the first and second indicia and having formed thereon the numeral representative depressions; and the face of each one of the game pieces including demarcation indicia that divides the face into two substantially equal face portions.

11. The domino game apparatus of claim 10, wherein the demarcation indicia appearing on each one of the game pieces of the first set is in the form of an algebraic plus sign and the demarcation indicia appearing on the face of each one of the game pieces of the second set in the form of an algebraic negative sign.

* * * * *